US005689916A

United States Patent [19]

Jensen et al.

[11] Patent Number: 5,689,916

[45] Date of Patent: Nov. 25, 1997

[54] WINDOW PARTICULARLY FOR INSTALLATION IN AN INCLINED ROOF SURFACE

[75] Inventors: Jan Fahlen Jensen, Søborg; Klaus Kornerup, Birkerød, both of Denmark

[73] Assignee: V, Kann Rasmussen Industri A/S, Søborg, Denmark

[21] Appl. No.: 652,509

[22] PCT Filed: Dec. 9, 1994

[86] PCT No.: PCT/DK94/00461

§ 371 Date: May 31, 1996

§ 102(e) Date: May 31, 1996

[87] PCT Pub. No.: WO95/16097

PCT Pub. Date: Jun. 15, 1995

[30] Foreign Application Priority Data

Dec. 10, 1993 [DK] Denmark ..... 1383/93

[51] Int. Cl.[6] ..... E05D 15/30

[52] U.S. Cl. ..... 49/252; 267/175; 267/177; 49/253

[58] Field of Search ..... 49/252, 246, 379, 49/248, 253; 52/100; 267/69, 70, 71, 72, 169, 175, 177; 16/199, 200

[56] References Cited

U.S. PATENT DOCUMENTS

| | | | |
|---|---|---|---|
| 3,561,162 | 2/1971 | Goldman | 39/379 |
| 3,714,680 | 2/1973 | Little . | |
| 3,737,947 | 6/1973 | Little . | |
| 3,851,909 | 12/1974 | Hester et al. | 39/379 |
| 4,217,732 | 8/1980 | Reichstadt | 49/253 |
| 4,294,039 | 10/1981 | Dalheimer et al. | 49/248 |
| 4,706,333 | 11/1987 | Lauderbach . | |
| 4,991,675 | 2/1991 | Tosconi et al. | 49/379 |

FOREIGN PATENT DOCUMENTS

| | | |
|---|---|---|
| 0430721 | 12/1990 | European Pat. Off. . |
| 2206644 | 1/1989 | United Kingdom . |
| 89/10460 | 4/1989 | WIPO . |

*Primary Examiner*—Kenneth J. Dorner
*Assistant Examiner*—Curtis Cohen
*Attorney, Agent, or Firm*—Lane, Aitken & McCann

[57] ABSTRACT

A window, particularly for installation in an inclined roof surface, comprising a main frame and a frame hinged to the top thereof as well as a frame lifting arm inserted between the main frame and the frame, the arm having one end pivotally connected with a lateral member of the main frame or the frame and its other end pivotally connected with a slide shoe which in a longitudinally displaceable manner is connected with the corresponding lateral member of the main frame or the frame, respectively. The slide shoe is associated with a pre-stressed lifting spring, as a first coupling first coupling member on the slide shoe is adapted to engage with a second coupling member connected with the lifting spring when installing the window. Between the slide shoe and the lifting spring is an auxiliary spring, the pre-stressing of which can be adjusted in dependence on the roof inclination, by a manually operated adjusting element, for supplementing the spring force from the lifting spring within a given range of the opening angle of the window. The auxiliary spring can be accommodated in a spring box between an abutment which is stationary with respect to the spring box and an abutment which is movable along the spring box.

2 Claims, 2 Drawing Sheets

WINDOW PARTICULARLY FOR INSTALLATION IN AN INCLINED ROOF SURFACE

BACKGROUND OF THE INVENTION

This invention relates to a window, particularly for installation in an inclined roof surface, comprising a main frame and a frame hinged to the top thereof as well as a frame lifting arm inserted between the main frame and the frame, said arm having one end pivotally connected with a lateral member of the main frame or the frame and its other end pivotally connected with a slide shoe which in a longitudinally displaceable manner is connected with the corresponding lateral member of the frame or the main frame, respectively, and which is associated with a pre-stressed lifting spring, as a first coupling member on the slide shoe is adapted to be brought into engagement; with a second coupling member connected with the lifting spring when installing the window at the installation site.

Such a window is known e.g. from WO-A-89/10460. Herein is described how it is possible, by moving the point of action of the lifting spring, to alter the pre-stressing of the spring in dependence on the roof inclination. However, the pre-stressing interval is insufficient due to the constructive elaboration and the application is thus limited to roof inclinations within a relatively small angular range.

The object of the present invention is to provide a window in which the window frame can easily be opened and at the same time be kept in a stable position of rest in the whole range of the opening angle for roof inclinations within a large angular range.

For obtaining this, the Window is, according to the invention, characterized in chat an auxiliary spring is located between the slide shoe and the lifting spring, the pre-stressing of which can be adjusted in dependence on the roof inclination, by means of a manually operated adjusting element, to exert a parallel spring force for supplementing the spring force from the lifting spring within a given range of the opening angle of the window.

It is thereby possible to obtain a spring bias which makes the force to be added by the user of the window manageable when opening and closing the window frame, while at the same time the spring moment is adjusted in such a way that the window can be parked in a stable position of rest at an arbitrary opening angle of the window.

By pre-stressing the auxiliary spring, the window according to the invention can be applied in a roof with different roof inclinations within an angular range covering even very small angles, as e.g. 20°. In the case of large roof inclinations, the pre-stressing of the auxiliary spring is not required, as the lifting spring alone provides the required bias force.

The auxiliary spring is preferably installed as a compression spring and is accommodated in a spring box placed on the tie rod between the lifting spring and a guide rail for the slide shoe between an abutment which is stationary with respect to the tie rod and an abutment which is movable along the spring box.

Hereby the auxiliary spring can easily be manually pre-stressed by moving the movable abutment to a position where the auxiliary spring will be compressed and thereby pre-stressed.

BRIEF DESCRIPTION OF THE DRAWINGS

In the following, the invention will be explained in detail with reference to the accompanying drawings, in which.

DETAILED DESCRIPTION OF THE PREFERRED EMBODIMENTS

Figure 1:
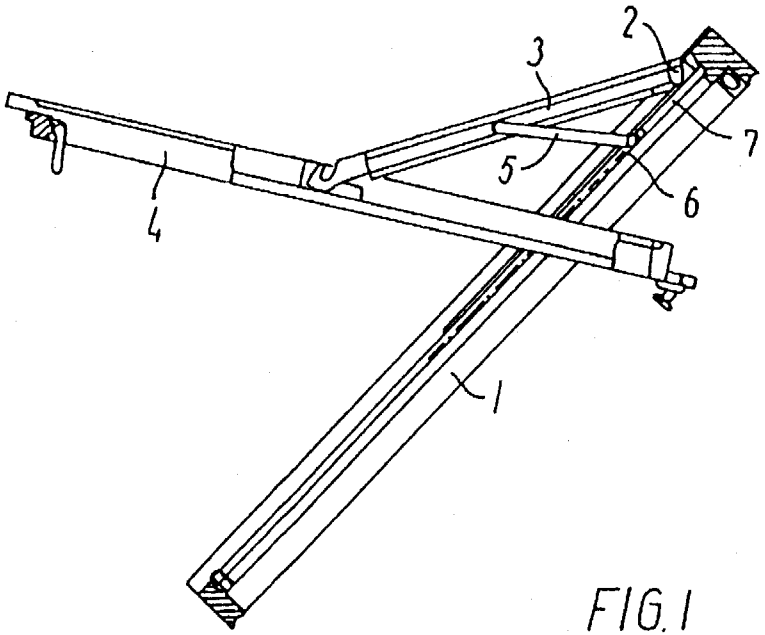
FIG. 1 illustrates a known window in a schematic side elevation, partially in section, the window being in its open position and the glass-carrying frame released from the intermediate frame.

The window main frame 1 illustrated in FIG. 1 is, by means of hinges 2, connected in the top with an intermediate frame 3, which constitutes a support to a glass-carrying pivotal frame 4. The pivotal frame 4 is normally connected with the intermediate frame 3 by means of an upper closing means, not shown, the hinges 2 thus being in use at normal operation of the frame during opening and closing, while the pivoting function is mainly used for cleaning the outside of the glass. The intermediate frame 3 is supported on each side by lifting arms 5 pivotally connected with the frame 3 at one end and at their other end pivotally connected with slide shoes 6, which are displaceable in a longitudinal direction in guide rails 7 on the upwards facing sides of the main frame or the frame.

Figure 2:
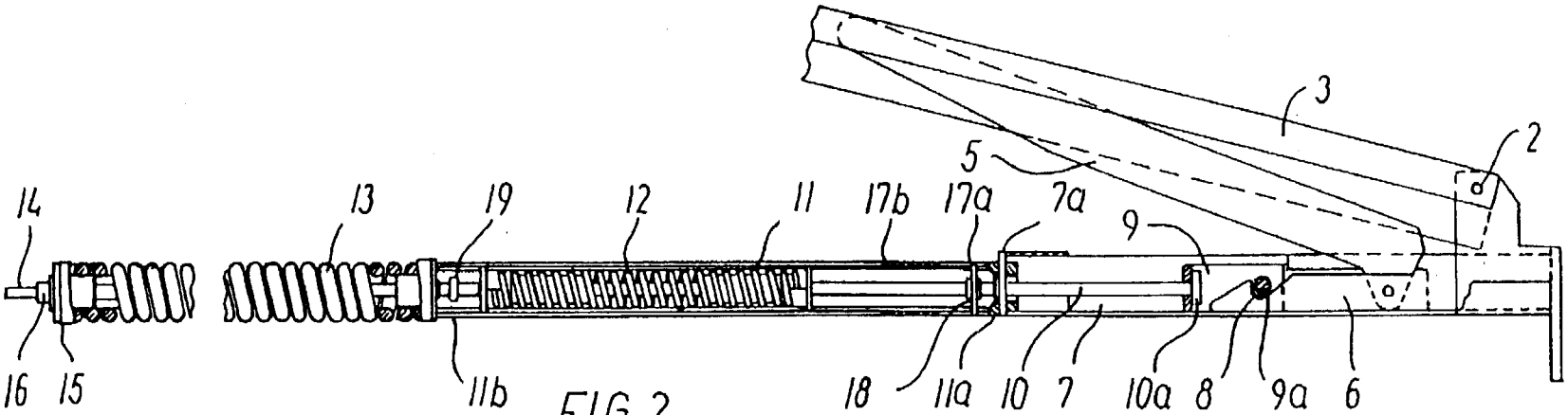
FIG. 2 is a schematic side elevation, partially in section, of one of the top corners of the window, and FIGS. 3–5 moment graphs on the moments of the frame weight and the spring force about a hinge axis through the hinges.

FIG. 2 illustrates one of the top corners of the window seen from the side. In its side facing the lifting arm 5, the slide shoe 6 has a hook-shaped recess 8 for engagement with a coupling member 9. The coupling member 9 is U-shaped and is, in its mounted position, placed in such a way that the U-branches are positioned on either side of the slide shoe 6 and a transverse pin **9*a* between the U-branches can engage with the recess 8. The upper end of a tie rod 10 extends through a hole in the bottom of the coupling member 9 and has a head 10*a* abutting thereon. In its lower end facing away from the hinges 2, the guide rail 7 has an end bottom 7*a* firmly connected with a top end 11*a* of a spring box 11 having a U-shaped cross section and guiding an auxiliary spring 12. A bottom end 11*b* of the spring box 11 constitutes an abutment for the top end of a lifting spring 13, which at its bottom end 14 has a bush 15 with a nut 16. The lifting spring 13 can be pre-stressed to a desired value by screwing the nut 16** upwards towards the upper end of the tie rod.

In its wall near the top end **11*a*, the spring box 11 has a recess 17*a* for receiving a movable abutment 18. Below the recess 17*a*, in the wall of the spring box 11, there is a plurality of successive recesses 17*b*, which are also adapted for receiving the movable abutment 18. The bottom end of the auxiliary spring 12 bears against an abutment 19 which is stationary with respect to the tie rod 10 and can be pre-stressed to a desired value by moving the movable abutment 18 from the recess 17*a* to one of the recesses 17*b*, so that the spring 12 will be compressed between the abutments 18 and 19**.

Figure 3:
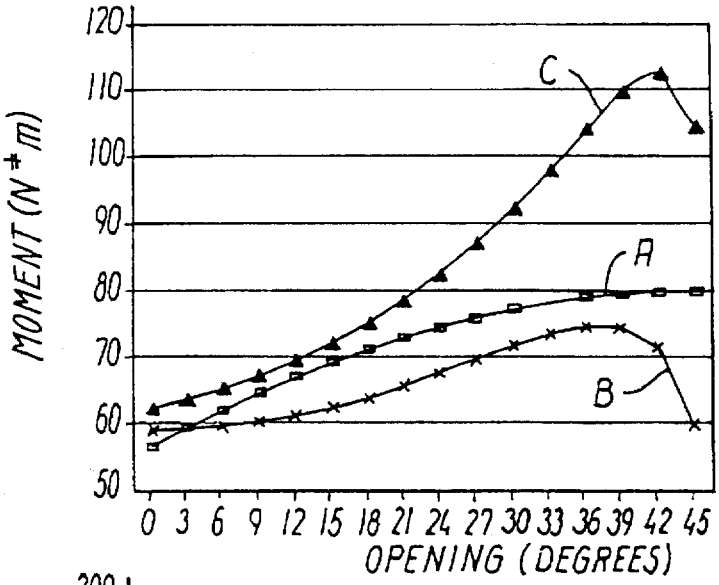

In FIG. 3, moment graphs are shown for the frame and the springs, respectively, for moments about the hinge axis through the hinges 2 as a function of the opening angle of the frame for a window installed in a roof with a 45° inclination. Graph A indicates the moment of the frame weight about the hinge axis, where, as expected, the highest value of the moment is at an opening angle of 45° i.e. when the frame is in a horizontal position. Graph B indicates the effective spring moment when opening the frame, where the moment corresponds to the effect of the springs on the frame through the lifting arm 5. This moment depends on the pre-stressing of the springs 12 and 13 as well as on the opening angle. In the graph shown, this moment solely originates from the pre-stressing of the lifting spring 13, while the auxiliary spring 12 is inactive, as the movable abutment 18 is placed in a neutral position in the recess 17*a*, which is placed in such a way that the auxiliary spring 12 at no time is deformed during the opening of the window frame. The force which the user of the window needs to add to open the frame has a moment corresponding to the difference between the graphs A and B. As it will appear from the Figure, the spring alone is capable of opening the frame within an angle of up to approx. 3°, as graph B is above graph A within this angular range. Graph C indicates the effective spring moment when closing the window, this moment being dependent on the same factors as the moment during the opening. As both the spring force and the friction must be overcome when closing the window, this moment is higher than the above and the force to be added in order to close the window will thus have a moment corresponding to the difference between the graphs C and A. As is apparent from the above, it will be possible to place the window in a stable position of rest within the angular ranges where graph A is between the graphs B and C.

Figure 4:
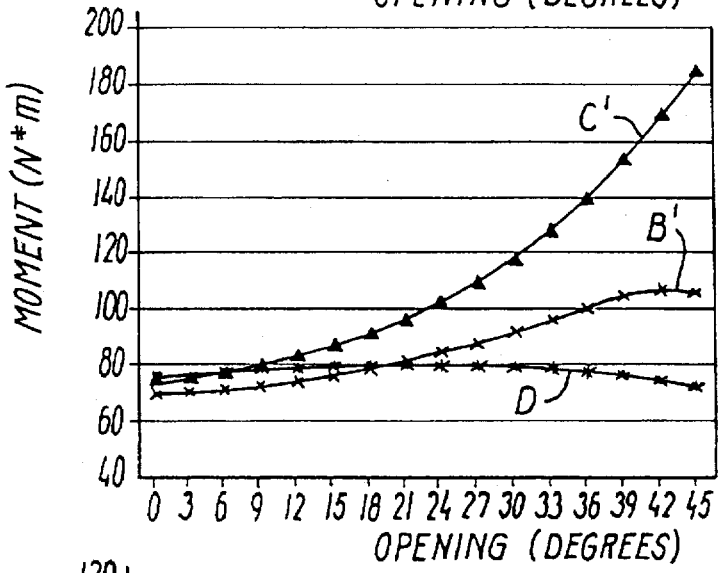

FIG. 4 illustrates similar moment graphs for a window installed in a roof with a 20° inclination. In this, graph D indicates the moment of the frame weight, while graph B' corresponds to graph B and graph C' to graph C in FIG. 3. As in FIG. 3, the spring moment is provided by the lifting spring 13 alone, as also in this case the auxiliary spring 12 is inactive as the abutment 18 is placed in the recess 17*a*. As the moment of the frame weight is higher at the point of opening of the window than in case of a 45° roof inclination, the spring 13 must be pre-stressed to a higher value in this case, so that a higher effective spring moment will be obtained in order to easily open the window. As it will appear from the Figure, the spring moment during the opening, graph B', will at a given opening angle, which in this case is approx. 21°, be higher than the moment of the frame weight, which will cause the frame to open by itself during the continued opening movement. During closing of the window, the spring moment, graph C', is lower than the moment of the frame weight at a given angle, which in this case is approx. 6°, and within this angular range the window will be self-closing. This implies that the window frame can only be placed in a stable position of rest within a small angular range, which in this case ranges from 6° to 21°.

Figure 5:
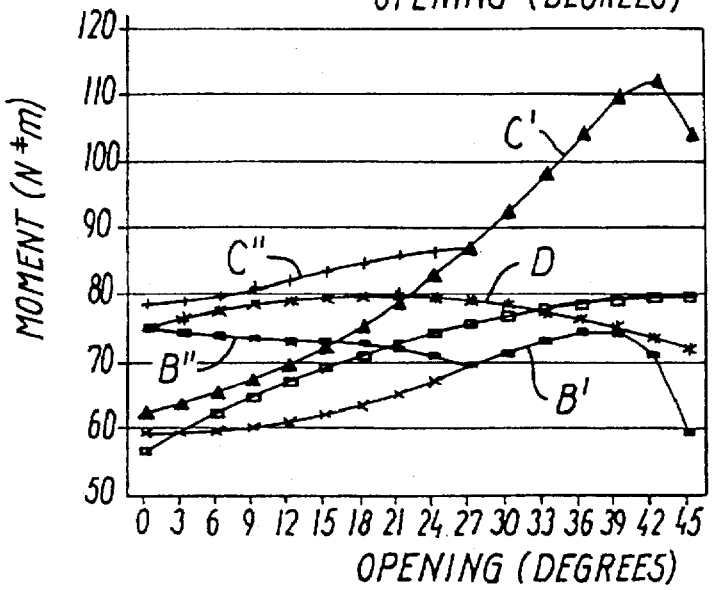

FIG. 5 shows the graphs corresponding to FIGS. 3 and for a roof inclination of 20°, however with the auxiliary spring 12 being pre-stressed, as the abutment 18 has been moved to an active position in one of the recesses 17*b*. At the same time, the lifting spring 13 is pre-stressed to essentially the same value as in the case of a 45° roof inclination. The effective spring moment when opening the window is described by the graphs B" and B'. Graph B" indicates the total spring moment of the auxiliary spring 12 and the lifting spring 13. The pre-stressing has been adjusted in such a way that the total spring moment balances the moment of the frame weight at the point of opening of the window. During the opening, the lifting spring 13 and the auxiliary spring 12 cooperate up to a given opening angle, which in this case is approx. 27°, and which will be dependent on the pre-stressing of the auxiliary spring 12. At this opening angle, the auxiliary spring 12 is undeformed and thus no longer contributes to the total spring moment, for which reason the lifting spring 13, as is apparent from graph B', operates alone in the angular range from this opening angle and up to a completely open position of the window. Similarly, the graphs C" and C' describe the total spring moment during closing of the window. In the angular range from a completely open position of the window to the angle in which the abutment 18 again strikes the auxiliary spring 12, only the lifting spring 13 needs to be pre-stressed, and the effective spring moment is described by graph C'. Beyond this point the auxiliary spring 12 is compressed and prestressed as well, which results in the joint moment graph C".

With this cooperation between the lifting spring and the auxiliary spring, it will be possible to place the frame in a stable position of rest at arbitrary opening angles, as the moment of the frame weight is constantly higher than the effective spring moment during the opening and lower than the spring moment during the closing of the window frame.

We claim:

1. A window, particularly for installation in an inclined roof surface, having an opening angle and comprising a main frame (1) having a top and a frame (3,4) hinged to the top thereof as well as a frame lifting arm (5) inserted between the main frame and the frame, said arm having two ends, one end pivotally connected with a lateral member of one of the main frame and the frame, and its other end pivotally connected with a slide shoe (6) which in a longitudinally displaceable manner is connected with the corresponding lateral member of the other of the frame and the main frame, and which is associated with a pre-stressed lifting spring (13), as a first coupling member (8) on the slide shoe is adapted to be brought into engagement with a second coupling member (9) connected with the lifting spring when installing the window at the installation site, characterized in that an auxiliary spring (12) is located between the slide shoe (6) and the lifting spring (13), pre-stressing of which can be adjusted depending on the roof inclination, by means of a manually operated adjusting element, to exert a parallel spring force for supplementing the spring force from the lifting spring within a given range of the opening angle of the window.

2. A window as claimed in claim 1, in which the lifting spring (13) is installed as a compression spring at one end of a tie rod (10) connected with said second coupling member, characterized in that the auxiliary spring (12) is accommodated in a spring box (11) placed on the tie rod (10) between the lifting spring (13) and a guide rail (7) for the slide shoe (6), between an abutment (19) which is stationary with respect to the tie rod and an abutment (18) which is movable along the spring box and which constitutes said adjusting element.

* * * * *

UNITED STATES PATENT AND TRADEMARK OFFICE

CERTIFICATE OF CORRECTION

PATENT NO. : 5,689,916

DATED : November 25, 1997

INVENTOR(S) : Jan Fahlen Jensen et al.

It is certified that error appears in the above-indentified patent and that said Letters Patent is hereby corrected as shown below:

Column 1, after line 26, SUMMARY OF THE INVENTION should be inserted;

line 33. "Window" should read --window--; and

Column 2, line 63, the comma after "45°" should be inserted.

Signed and Sealed this

Fifth Day of May, 1998

*Attest:*

*Attesting Officer*

Bruce Lehman

BRUCE LEHMAN

*Commissioner of Patents and Trademarks*